US009709353B1

(12) United States Patent
Viani

(10) Patent No.: US 9,709,353 B1
(45) Date of Patent: Jul. 18, 2017

(54) FIRING PIN SPRING RETAINING CLIP ASSEMBLY

(71) Applicant: Arthur J. Viani, Miami, FL (US)

(72) Inventor: Arthur J. Viani, Miami, FL (US)

( * ) Notice: Subject to any disclaimer, the term of this patent is extended or adjusted under 35 U.S.C. 154(b) by 0 days.

(21) Appl. No.: 15/155,492

(22) Filed: May 16, 2016

(51) Int. Cl.
*F41A 19/25* (2006.01)

(52) U.S. Cl.
CPC ..... *F41A 19/25* (2013.01)

(58) Field of Classification Search
CPC ..... F41A 19/25
USPC ..... 42/69.01
See application file for complete search history.

(56) References Cited

U.S. PATENT DOCUMENTS 5,157,209 A * 10/1992 Dunn ..... F41A 17/64 42/70.08
6,665,973 B1 * 12/2003 Peev ..... F41A 19/33 42/69.01
8,720,096 B2 * 5/2014 Siddle ..... F41A 19/29 42/69.01
2013/0180394 A1 * 7/2013 Siddle ..... F41A 19/29 89/132

OTHER PUBLICATIONS http://www.practicalshootingtips.com/the-glock-upgrade-no-one-actually-needs/ (as seen in webarchive https://web.archive.org/web/20141013225457/http:/www.practicalshootingtips.com/the-g lock-upgrade-no-one-actually-needs/) Oct. 13, 2014.*

* cited by examiner

*Primary Examiner* — Joshua Freeman
(74) *Attorney, Agent, or Firm* — Albert Bordas, P.A.

(57) ABSTRACT

A firing pin spring retaining clip assembly that displaces water and/or debris to enable a firing pin to move to discharge a firearm. The firing pin spring retaining clip assembly has at least one retaining clip with an exterior face and an interior face that extend between a first front edge and a rear edge. The at least one retaining clip further has at least one protrusion with a second front edge. The second front edge has a first width. The length is longer than the first width is wide. The at least one retaining clip mounts onto the firing pin having a retaining wall and a spring. In another embodiment, the at least one retaining clip also has at least one full protrusion having a third front edge and the length of the first front edge is also longer than width of the third front edge.

20 Claims, 3 Drawing Sheets

FIRING PIN SPRING RETAINING CLIP ASSEMBLY

BACKGROUND OF THE INVENTION

1. Field of the Invention

The present invention relates to firearm accessories, and more particularly, to firing pin spring retaining clips.

2. Description of the Related Art

Firing pin spring cups have been developed in the past.

However, in maritime settings, or when submerged or exposed to water, these spring cups often retain a spring on a firing pin, which can impede the movement of the firing pin if a channel is full of water and the firearm cannot be discharged.

Applicant is not aware of any firing pin spring cups that suggest the novel features of the present invention.

SUMMARY OF THE INVENTION

The instant invention is a firing pin spring retaining clip assembly, comprising at least one retaining clip having an exterior face and an interior face that extend between a first front edge and a rear edge. The first front edge has a length defined by first and second edges. The at least one retaining clip further comprises at least one protrusion comprising a second front edge. The second front edge has a first width. The length is longer than the first width is wide. The at least one retaining clip mounts onto a firing pin comprising a retaining wall and a spring, whereby the spring is biased against the at least one protrusion and the first front edge is biased against the retaining wall.

In a preferred embodiment, the at least one protrusion protrudes from the exterior face. In one embodiment, the first and second front edges are on a same plane. In another embodiment, the second front edge extends from the first front edge. In another embodiment, the second front edge extends approximately perpendicularly from the first front edge. The second front edge is defined by first and second front side edges. The at least one protrusion comprises an exterior wall and at least one sidewall. The at least one protrusion also comprises a rear wall, whereby the rear wall has a second width. In a preferred embodiment, the second width is wider than the first width. The spring is biased against the rear wall, and the rear wall is defined by first and second rear edges. The interior face contours the firing pin.

In another embodiment, the at least one retaining clip further comprises at least one full protrusion having a third front edge. The third front edge has a width, and the length of the first front edge is also longer than width of the third front edge is wide. In one embodiment, the first and third front edges are on a same plane. In another embodiment, the third front edge extends from the first front edge. In another embodiment, the third front edge extends approximately perpendicularly from the first front edge. The third front edge is also defined by front side edges. The at least one full protrusion comprises an exterior wall and at least one sidewall. The at least one full protrusion comprises a rear wall, whereby the rear wall also has a width. The width of the rear wall is wider than the width of the third front edge. The spring is also biased against the rear wall of the at least one full protrusion, whereby the rear wall is also defined by rear edges.

It is therefore one of the main objects of the present invention to provide a firing pin spring retaining clip assembly.

It is another object of this invention to provide a firing pin spring retaining clip assembly for firearms utilized in marine environments.

It is another object of this invention to provide a firing pin spring retaining clip assembly for firearms submerged or exposed to water and/or debris.

It is another object of this invention to provide a firing pin spring retaining clip assembly that displaces water and/or debris to enable a firing pin to move and discharge a firearm.

It is another object of this invention to provide a firing pin spring retaining clip assembly that allows a firearm to be discharged underwater, or after it was submerged, without having to field strip it.

It is another object of this invention to provide a firing pin spring retaining clip assembly, which is of a durable and reliable construction.

It is yet another object of this invention to provide such an assembly that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
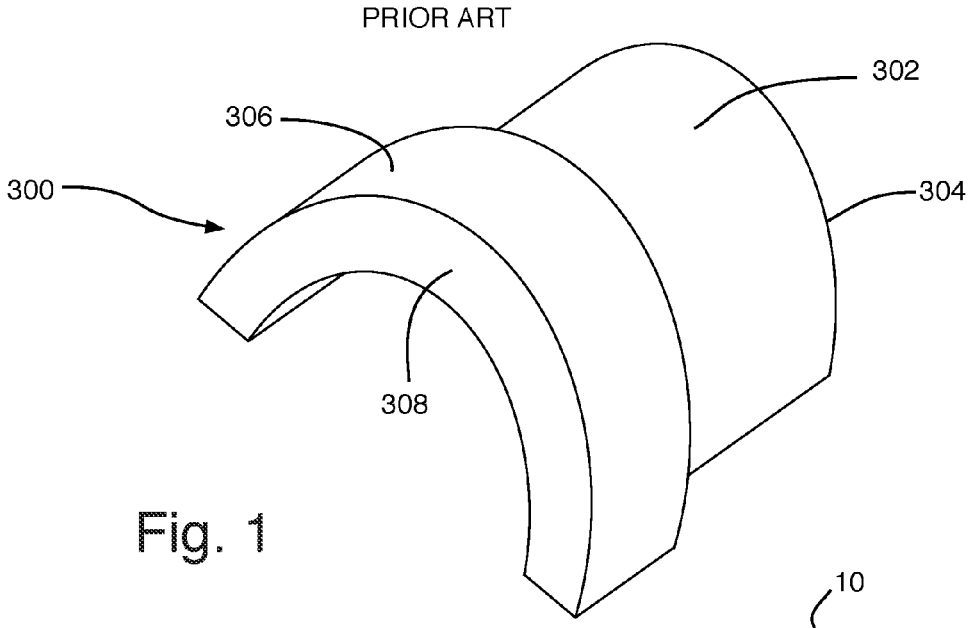
FIG. 1 is an isometric view of a prior art firing pin spring cup.

Referring now to the drawings, the present invention is a firing pin spring retaining clip assembly and is generally referred to with numeral 10. In one embodiment, it basically includes a single retaining clip 20, and in a preferred embodiment, it includes retaining clips 20 and 20'.

As seen in FIG. 1, prior art spring cup 300 comprises exterior wall 302 that extends from rear end 304 to spring retaining wall 306, and spring retaining wall 306 extends to cup front edge 308. In use, a pair of spring cups 300 is mounted onto a firing pin, like firing pin 200 comprising retaining wall 214 and spring 212 seen in FIG. 4, whereby a spring is biased against spring retaining wall 306 and cup front edge 308 is biased against the retaining wall. In maritime settings, or when submerged or exposed to water, prior art spring cups 300 often retain the spring on the firing pin, which can impede the movement of the firing pin if a channel is full of water and the firearm, not seen, cannot be discharged.

Figure 2:
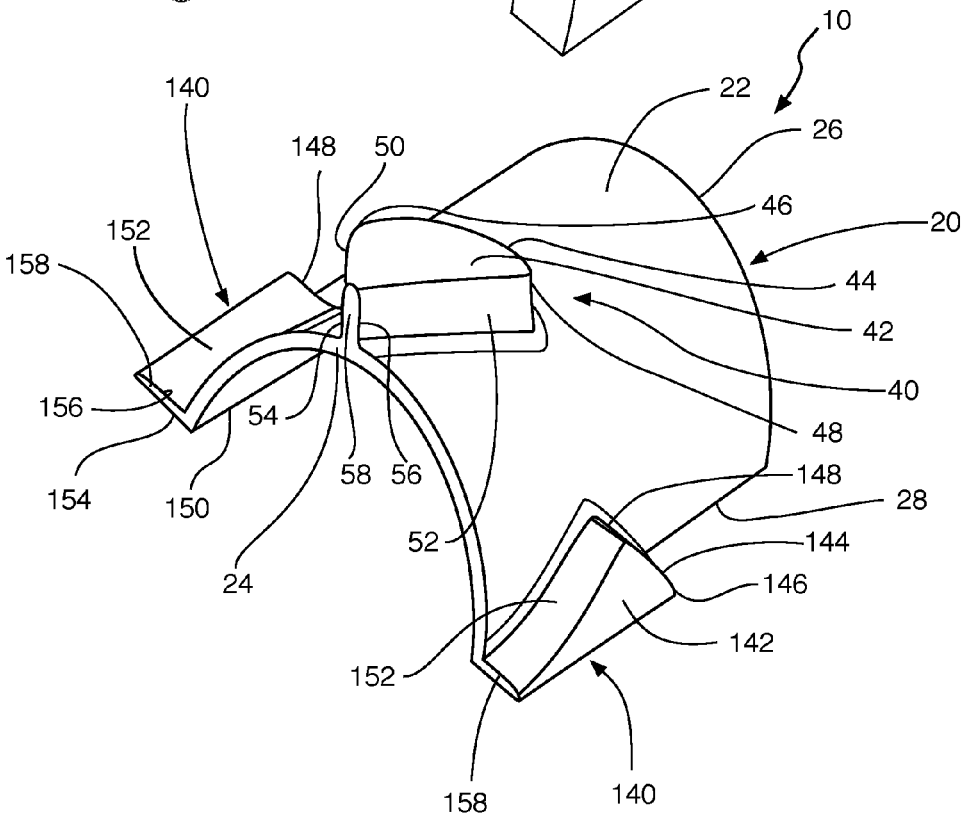
FIG. 2 is an isometric view of a firing pin spring retaining clip assembly.

As seen in FIG. 2, the present invention is a firing pin spring retaining clip assembly and is generally referred to with numeral 10. In one embodiment, it basically includes at least one retaining clip 20, whereby retaining clip 20 can have a semi-circular shape as illustrated, a semi c-shape or a c-shape, whereby exterior face 22 extends a greater distance from one of edges 28. In the semi-circular shape as illustrated, semi c-shape and c-shape configuration, retaining clip 20 will contour and mount onto firing pin 200, seen in FIG. 4.

Figure 3:
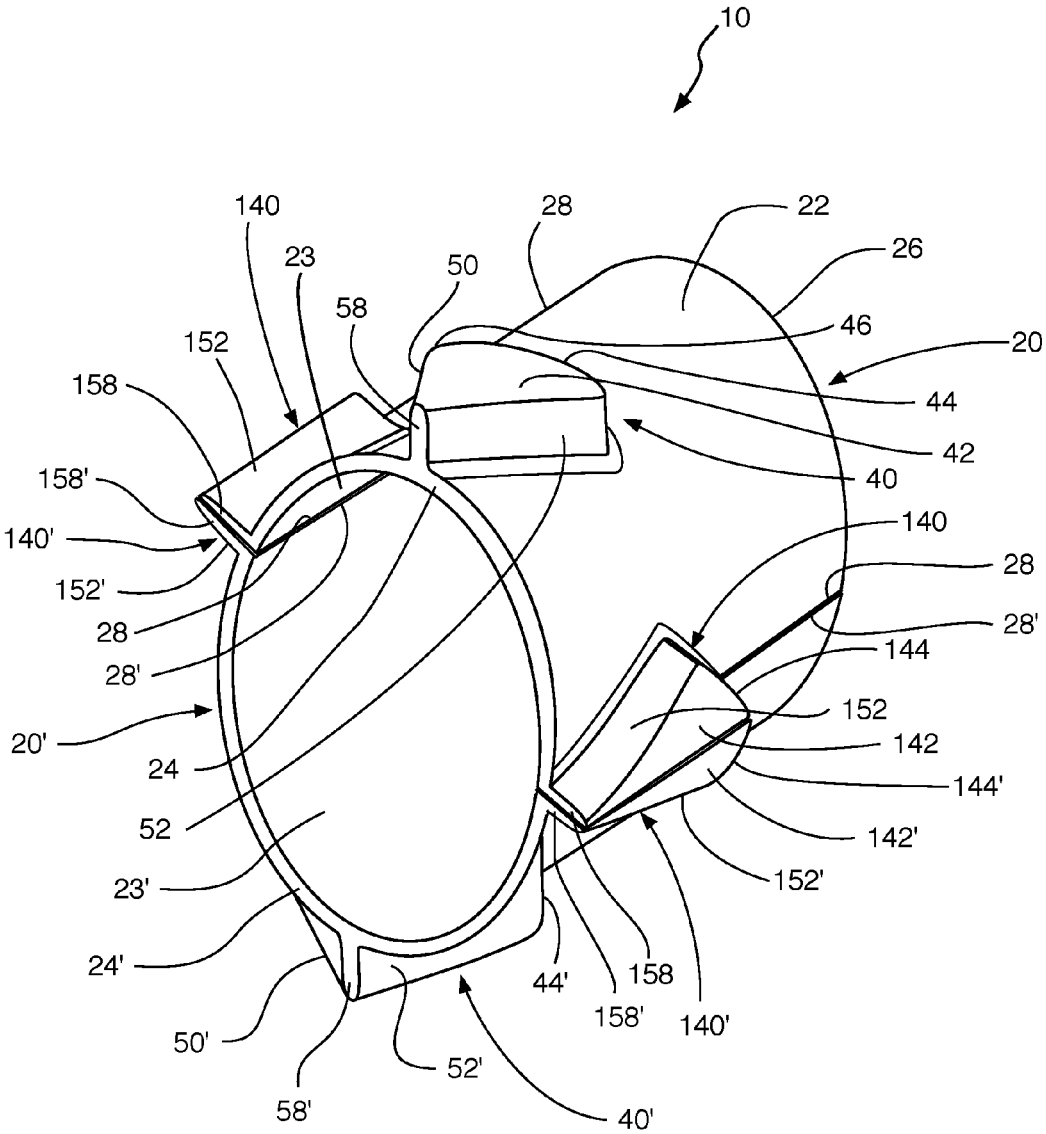
FIG. 3 is an isometric view of a pair of firing pin spring retaining clip assemblies.
Figure 4:
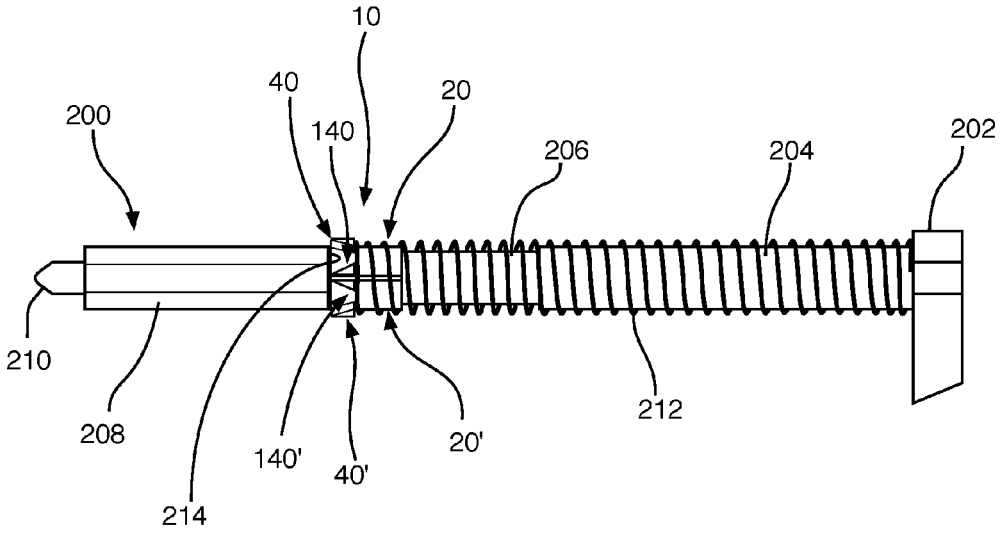
FIG. 4 is an elevation view of the pair of firing pin spring retaining clip assemblies mounted onto a firing pin of a firearm.

As seen in FIGS. 2 and 3, retaining clip 20 comprises exterior face 22 and interior face 23 that extend between front edge 24 and rear edge 26. Front edge 24 has a length defined by first and second edges 28. Retaining clip 20 further comprises at least one protrusion 140 comprising front edge 158. Front edge 158 has a width. The length of front edge 24 is longer than the width of front edge 158. As seen in FIG. 4, firing pin 200 comprises retaining wall 214 and spring 212. Retaining clip 20 mounts onto firing pin 200, whereby spring 212 is biased against protrusion 140 and front edge 24 is biased against retaining wall 214. Protrusion 140 protrudes from exterior face 22. In one embodiment as illustrated, front edges 24 and 158 are on a same plane. In another embodiment as illustrated, front edge 158 extends from front edge 24. In another embodiment as illustrated, front edge 158 extends approximately perpendicularly from front edge 24. Front edge 158 is defined by first and second front side edges 154 and 156 respectively. Protrusion 140 comprises exterior wall 142 and sidewalls 150 and 152. Protrusion 140 also comprises rear wall 144. Rear wall 144 has a width. In a preferred embodiment, the width of rear wall 144 is wider than the width of front edge 15. As seen in FIG. 4, in one embodiment, spring 212 is biased against rear wall 144, and rear wall 144 is defined by first and second rear edges 146 and 148 respectively. Interior face 23 contours firing pin 200, and specifically extension 206 of firing pin 200.

In another embodiment, retaining clip 20 may also comprise at least one full protrusion 40 having front edge 58. Front edge 58 has a width, and the length of front edge 24 is also longer than width of front edge 58. In one embodiment as illustrated, front edges 24 and 58 are on a same plane. In another embodiment as illustrated, front edge 58 extends from front edge 24. In another embodiment as illustrated, front edge 58 extends approximately perpendicularly from front edge 24. Front edge 24 is also defined by front side edges 54 and 56 respectively. Full protrusion 40 comprises exterior wall 42 and sidewalls 50 and 52. Full protrusion 40 comprises rear wall 44. Rear wall 44 also has a width. The width of rear wall 44 is wider than the width of front edge 58. As seen in FIG. 4, in one embodiment, spring 212 is also biased against rear wall 44, and rear wall 44 is defined by first and second rear edges 46 and 48 respectively.

As seen in FIG. 3, in a preferred embodiment, present invention 10 includes retaining clips 20 and 20'. In the preferred embodiment, retaining clips 20 and 20' are of a same shape, size, and dimension. Furthermore, in the preferred embodiment, retaining clips 20 and 20' are mirror images of each other when joined as illustrated, and when mounted onto firing pin 200, seen in FIG. 4, of a firearm, not seen.

As retaining clip 20' is of the same shape, size, and dimension as retaining clip 20, it comprises interior face 23', front edge 24', and edges 28'. Similarly, retaining clip 20' also comprises at least one protrusion 140'. Protrusion 140' comprises exterior wall 142', rear wall 144', sidewall 152', and front edge 158'. Similarly, retaining clip 20' may also comprise at least one full protrusion 40'. Protrusion 40' comprises rear wall 44', sidewalls 50' and 52', and front edge 58'.

In a preferred embodiment, at least one protrusion 140 is of any shaped configuration to displace liquid matter, and semi-solid and/or solid particles, enabling a firearm to discharge underwater or after being submerged in the liquid matter, and/or exposed to the semi-solid and/or solid particles. In a preferred embodiment, protrusions 140 and 140' together will generally make a shaped configuration similar to that of a single full protrusion 40. At least one protrusion 140 can be of any geometric shape to resemble a wedge or division, including, but not limited to triangular, diamond, arrow, etc.

Similarly, at least one full protrusion 40 is also of any shaped configuration to displace liquid matter, and semi-solid and/or solid particles, enabling the firearm to discharge underwater or after being submerged in the liquid matter, and/or exposed to the semi-solid and/or solid particles. Similarly, at least one full protrusion 40 can be of any geometric shape to resemble a wedge or division, including, but not limited to triangular, diamond, arrow, etc.

The liquid matter may comprise any liquid and/or any water including, but not limited to, fresh water, salt water, and/or brine. The liquid matter may also comprise semi-solid and/or solid particles. Such semi-solid and/or solid particles may for example include debris, dirt, shavings, dust, sand, lint, metal, etc. or any combinations thereof.

As seen in FIG. 4, firing pin 200 comprises arm 202. Extending from arm 202 is shaft 204 that extends to extension 206. Extension 206 extends to retaining wall 214. Retaining post 208 extends from retaining wall 214 to tip 210. Spring 212 is positioned over shaft 204 and extension 206.

In a preferred embodiment, retaining clips 20 and 20' mount onto firing pin 200, whereby spring 212 is biased against rear walls 144, 44, 144' and 44'; and front edges 24, 58, 158, 24', 58', 158' are biased against retaining wall 214.

Present invention 10 therefore allows a firearm, not seen, to be discharged underwater, after it was submerged in water, and/or exposed to semi-solid and/or solid particles, without having to field strip it, whereby at least one protrusion 140 and/or at least one full protrusion 40 of retaining clip 20 and/or retaining clip 20' displaces the liquid matter, semi-solid and/or solid particles to enable firing pin 200 to move and discharge the firearm.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A firing pin spring retaining clip assembly, comprising at least one retaining clip comprising an exterior face and an interior face that extend between a first front edge and a rear edge, said first front edge having a length defined by first and second edges, said at least one retaining clip further comprising at least one protrusion comprising a second front edge, said second front edge has a first width, said length is longer than said first width is wide, said at least one retaining clip mounts onto a firing pin comprising a retaining wall and a spring, whereby said spring is biased against said at least one protrusion and said first front edge is biased against said retaining wall, said at least one protrusion comprises a rear wall, whereby said rear wall has a second width, said second width being wider than said first width.

2. The firing pin spring retaining clip assembly set forth in claim 1, further characterized in that said at least one protrusion protrudes from said exterior face.

3. The firing pin spring retaining clip assembly set forth in claim 1, further characterized in that said first and second front edges are on a same plane.

4. The firing pin spring retaining clip assembly set forth in claim 1, further characterized in that said second front edge extends from said first front edge.

5. The firing pin spring retaining clip assembly set forth in claim 1, further characterized in that said second front edge extends approximately perpendicularly from said first front edge.

6. The firing pin spring retaining clip assembly set forth in claim 1, further characterized in that said at least one protrusion comprises an exterior wall and at least one sidewall.

7. The firing pin spring retaining clip assembly set forth in claim 1, further characterized in that said spring is biased against said rear wall.

8. The firing pin spring retaining clip assembly set forth in claim 1, further characterized in that said rear wall is defined by first and second rear edges.

9. The firing pin spring retaining clip assembly set forth in claim 1, further characterized in that said interior face contours said firing pin.

10. The firing pin spring retaining clip assembly set forth in claim 1, further characterized in that said second front edge is defined by first and second front side edges.

11. The firing pin spring retaining clip assembly set forth in claim 1, further characterized in that said at least one retaining clip further comprises at least one full protrusion comprising a third front edge, said third front edge has a second width, said length is longer than said second width is wide.

12. The firing pin spring retaining clip assembly set forth in claim 11, further characterized in that said first and third front edges are on a same plane.

13. The firing pin spring retaining clip assembly set forth in claim 11, further characterized in that said third front edge extends from said first front edge.

14. The firing pin spring retaining clip assembly set forth in claim 11, further characterized in that said third front edge extends approximately perpendicularly from said first front edge.

15. The firing pin spring retaining clip assembly set forth in claim 11, further characterized in that said at least one full protrusion comprises an exterior wall and at least one sidewall.

16. The firing pin spring retaining clip assembly set forth in claim 11, further characterized in that said at least one full protrusion comprises a rear wall, said rear wall has a third width.

17. The firing pin spring retaining clip assembly set forth in claim 16, further characterized in that said third width is wider than said second width.

18. The firing pin spring retaining clip assembly set forth in claim 16, further characterized in that said spring is biased against said rear wall.

19. The firing pin spring retaining clip assembly set forth in claim 16, further characterized in that said rear wall is defined by first and second rear edges.

20. The firing pin spring retaining clip assembly set forth in claim 1, further characterized in that said third front edge is defined by first and second front side edges.

* * * * *